United States Patent [19]

Zahner

[11] Patent Number: 5,018,286

[45] Date of Patent: May 28, 1991

[54] TAMPER RESISTANT SKI TICKET

[76] Inventor: Daniel B. Zahner, 3060 29th St., #12, Boulder, Colo. 80301

[21] Appl. No.: 511,480

[22] Filed: Apr. 18, 1990

[51] Int. Cl.[5] ..... G09F 3/10

[52] U.S. Cl. ..... 40/299; 40/663; 40/664; 40/665; 24/16 PB; 292/307 A

[58] Field of Search ..... 40/663, 664, 665, 662, 40/299, 630, 6, 27, 586, 642, 638; 283/74, 75, 80, 81, 101; 24/16 PB, 30.5 R; 292/307 R, 307 A, 308, 309, 325; 20/20-37, 40, 42

[56] References Cited

U.S. PATENT DOCUMENTS

| | | | |
|---|---|---|---|
| 267,486 | 11/1882 | Brooks | 40/665 |
| 626,198 | 5/1899 | Wheelock | 40/665 |
| 3,130,509 | 4/1964 | Brooks | 40/662 |
| 3,241,255 | 3/1966 | Hanley . | |
| 3,662,480 | 5/1972 | Gilson et al. . | |
| 3,686,717 | 8/1972 | Merser | 40/662 X |
| 3,757,936 | 9/1973 | Lindegren | 24/16 PB X |
| 3,777,378 | 12/1973 | Sant'Anselmo | 40/27 |
| 3,933,560 | 1/1975 | Mutters . | |
| 4,209,189 | 6/1980 | Betterley . | |
| 4,300,297 | 11/1981 | Betterley . | |

FOREIGN PATENT DOCUMENTS

| | | | |
|---|---|---|---|
| 400473 | 4/1966 | Switzerland | 40/665 |

*Primary Examiner*—Kenneth J. Dorner
*Assistant Examiner*—J. Hakomaki
*Attorney, Agent, or Firm*—Francis A. Sirr; Earl C. Hancock

[57] ABSTRACT

A user authorization tag for the wearer thereof is rendered tamper resistant by forming the tag as an integral unit having a flat panel portion and a flexible loop portion extending from the panel portion. The loop is dimensioned for threading through a clothing opening, for example through a zipper pull, a button hole, or the like. Once the loop is threaded through the clothing opening, the panel is passed through the loop, to thereby secure the loop to the clothint opening. A relatively large ticket, carrying user authorization information such as bar code data, is then nonremovably secured to the panel. The size of the ticket is such that the panel with its attached ticket cannot pass back through the loop if an attempt is later made to remove the tag from the clothing. During use, the flat panel prevents the ticket from being wrinkled, folded, etc, and operates to hold the ticket in a flat state, for easy reading by a bar code scanner, or by visual observation, as user authorization is periodically checked.

27 Claims, 2 Drawing Sheets

TAMPER RESISTANT SKI TICKET

DESCRIPTION

1. Field of the Invention

The present invention relates to tags or tickets employed to identify authorized use of a facility or the like by the wearer of the tag. More particularly, the present invention relates to tags or tickets worn by authorized users of ski areas and the like.

2. Background of the Invention

There is a growing concern in the ski industry regarding the loss of revenue from the solicitation and resale of non-transferable tickets by the original ticket purchaser. The present paper and wire ticket design which is the industry standard is designed to be tamper-proof. However there are several methods to render these tickets capable of unauthorized transfer by the original purchaser after this purchaser has made at least partial use of the ticket.

The easiest of these methods of unauthorized transfer, and subsequently the technique of the most concern to the ski industry, is accomplished with a wire cutter and a can of automobile spray starting fluid (i.e. 99% ether). With this method the wire loop is cut, and the paper ticket is then sprayed with ether, temporarily melting the glue. A new metal loop or "wicket" is then easily inserted. All types of the presently known designs are susceptible to this treatment, and this treatment is practically undetectable. Once the ether has evaporated, the glue re-hardens and there is no indication of ticket tampering.

In addition to being easily transferred, other drawbacks of the presently known ticket designs are vulnerable to the stress and moisture that is inherent in a normal day of skiing. Many designs are also much larger and cumbersome than is desirable, often becoming a distraction to the skier. However, these deficiencies of the currently known designs are certainly of minor importance when compared to the susceptibility to tamper and transfer.

U.S. Pat. No. 3,662,480 is considered typical of the prior art. In this patent a wire frame or wicket 32 is first secured to the wearer by first passing the wire frame through a clothing opening, in this case a ring 26. An adhesive backed paper ski ticket 31 is then folded and applied to the wire frame by pressing the ticket panels together, thus trapping the wire frame within the folded ticket. This construction allows the wire frame to be cut, and the ski ticket to be transferred to another article of clothing, as the ends of the cut wire frame are joined back together again. In addition, no means are provided to insure that the ski ticket remains flat and conveniently readable after extended usage. U.S. Pat. Nos. 3,241,255 and 3,933,560 are generally similar in their teachings.

U.S. Pat. No. 4,300,297 describes another form of prior art wherein a self-wicketing ticket comprises a plastic vinyl tag, one side of which is coated with an adhesive. The tag includes either a strip or a cord that is first passed through a clothing opening, such as a zipper pull. The end of the strip or cord is then captured by folding the tag's adhesive side against itself. While this arrangement may provide a measure of protection against transfer of the ticket from one article of clothing to another, the ticket's printed indicia of authorization some becomes obscure as the paper ticket is wrinkled during use. U.S. Pat. No. 4,209,189 is generally similar in its teaching.

Overall, the prior art ticket tags may have proven to be effective designs for their general intended purposes. However, all fall short of providing for an extended period of ski ticket indicia readability, and of providing an extra measure of security against fraud and unauthorized ticket resale, both of which are very important to the ski industry.

For example, the use of bar code scanning to verify usage of a ski lift, as the lift is being boarded, requires that the ski ticket remain physically intact and physically flat, so that the bar code thereon can be conveniently scanned. The prior art generally fails to address or satisfy these concerns.

SUMMARY OF THE INVENTION

The present invention provides a simple, secure, ease to use, and efficient system for event ticketing, for example ski lift ticketing. The ticketing system of the invention incorporates a plastic, injection molded, one piece tag of high strength, whose construction and arrangement eliminates transfer of the ticket between the clothing of different individuals. The use of molding materials having a variety of colors enables this parameter of the tag to carry additional information as to the class of ticket purchased, for example. The ticket portion of the invention may comprise a plastic paper member that will not tear, and is capable of withstanding temperature extremes. Once the ticket is secured to the tag, the tickets validation data is maintained in a flat condition, thus providing for ease of reading. In this manner, the invention is conducive to use with a wide variety of ticket/validation systems.

The present invention comprises a tag that is capable of general identification utility, such as for identifying luggage, personal items, etc. However, the tag of the invention is of special utility for providing a tamper resistant tag/ticket combination that indicates a personal, non-transferable, authorization of paid access to a facility such as a ski area, a golf tournament, a sporting event, a gathering such as a convention, or the like.

An object of the invention is to provide a unitary tag assembly that is attachable to an individual's apparel as by passing a loop through an opening in the apparel, and then knotting the loop by passing a flat panel portion of the tag back through the loop. Thereafter an adhesive backed ticket is affixed to the panel portion. The size of the ticket is such that the ticket overlaps the loop, thus shortening the length of the loop. As a result, the ticket/tag combination is too large to pass back through the loop. The ticket/tag combination must then be cut in order to remove the combination. In use, the tag's flat panel portion maintains the ticket's validation area in a completely flat state, thereby making validation data easily readable, either by machine scanning or by human observation.

The tag of the invention comprises an integral unit having a flat panel portion and a flexible closed-loop portion extending from the flat panel portion. The panel portion comprises a thin, flat area that is dedicated to displaying visual information and/or bar code data identifying the authorization that has been granted to the wearer of the tag. The closed-loop portion comprises a thin, strong, flexible thread whose two ends are attached to one edge of the panel portion, to thus form the closed loop.

The flexible loop portion of the tag is adapted to be folded against itself at generally the middle of the loop. The loop is then inserted into an opening within the clothing of the tag wearer, of which a shirt button hole and a jacket zipper pull are two examples. After the loop has been inserted through the clothing opening, the loop's mid portion is opened up, and the tag's flat panel portion is passed therethrough. Pulling on the panel portion now causes the loop's mid portion to tighten about the clothing opening.

As a feature of the invention, the loop's mid portion includes a pair of tabs that are centrally located relative in the loop, these tabs serving to lock the loop tightly in place about the clothing opening.

A relatively large, thin, rectangular, ticket of authorization, having a self sealing adhesive backing, is now folded in half and then adhered to the panel portion. A typical ticket may be manufactured from paper stock from a more durable plastic paper of which the Tyvek brand and vinyl are examples.

Once the ticket has been secured to the tag's panel portion, the self sealing adhesive properties of the ticket entrap the portions of the loop that are adjacent to the panel, thus shortening the loop's effective length, and prevent subsequent removal without considerable damage being done to the ticket. The combined ticket and panel portion is considerably larger than the panel portion was prior to attachment of the ticket thereto. Thus, the ticket/panel combination is now too large to pass back through the now-smaller loop, if an attempt is made to remove the combination from the clothing opening, for example in an attempt to transfer the authorization that is represented by the ticket.

In addition, the ticket carries various indicia of authorization thereon. This indicia is held in a flat state by the tag's panel portion, even after extended use thereof. This authorization indicia may include machine readable bar code data and/or human readable printed text or image data. During extended use, the tag's panel portion prevents this data from becoming obscure and difficult to read, due to the fact that the indicia is continuously maintained in a flat and a conveniently readable state.

As a feature of the invention, the tag may be formed of a molded plastic, which may be of different colors to identify different classes of ticket authorization, such as, for example, a child's ski lift ticket as distinguished from an adult's ski lift ticket.

The tag of the invention is of a uniformly thin construction, thereby facilitating compact shipment of a supply of the tags, and later convenient use of the tags at the location of ticket sales. As a feature of the invention, the tag's panel portion may include a small opening therethrough to enable a supply of the tags to be stacked or hung on a dowel pin or the like at the ticket sale location.

By use of the present invention, a facility manager, such as a ski area operator, can specify the authorization information to be displayed on the ticket/panel, such as the date and month, and this information can be displayed in both bar code form and human readable form. Further, the facility management can readily detect detachment and a subsequent attempt to reattach the tag merely by inspecting for cutting of the plastic loop.

Those having normal skill in the art will recognize the foregoing and other objects, features, advantages and applications of the present invention from the following more detailed description of the preferred embodiments as illustrated in the accompanying drawing.

DETAILED DESCRIPTION OF THE INVENTION

A typical tag in accordance with the exemplary embodiments of the invention comprises a one piece, uniform thickness, injection molded tag of plastic or other suitable material, of which the brand Zytel Nylon is a preferred example. Particularly desirable characteristics of the molding material are that it have a relatively high resilience in cold weather, and that it have a high tensile strength, to thereby withstand the stresses inherent in a day of skiing.

Figure 1:
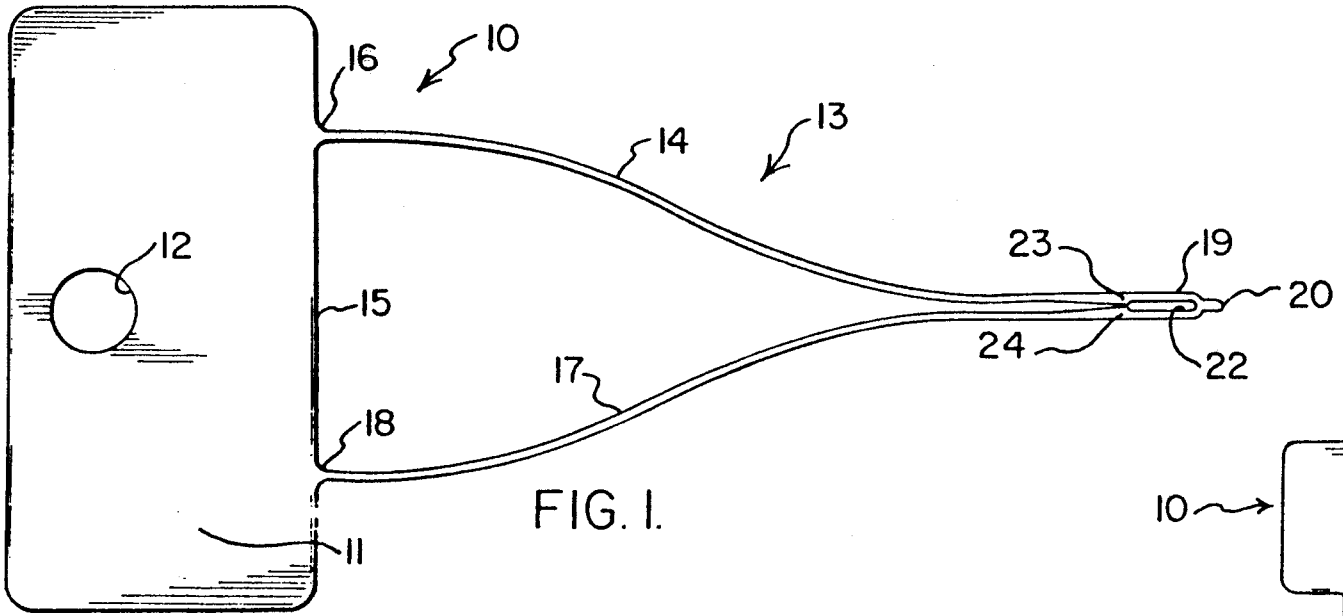
FIG. 1 is a top view showing the overall flat shape and proportions of a tag constructed in accordance with a preferred embodiment of the invention, the bottom view of the tag being identical to the top view.

FIG. 1 is a top view showing the overall flat shape and proportions of a tag 10 constructed in accordance with a preferred embodiment of the invention. The bottom view of tag 10 is substantially identical to the top view.

Tag 10 is a unitary, plastic, injection molded member having a flat wicket, panel, or main identification body portion 11 that can be made in any configuration other than the rectangular configuration shown. Without limitation thereto, for the preferred ski ticket usage panel portion 11 is a rectangle having dimensions of about 1.75 inches by about 0.87 inch. The thickness of tag 10 is about 0.02 inches.

A preferred material for tag 10 is a strong, tough, elastic synthetic polyamide type material, of which the brand Zytel Nylon is an example.

For purposes such as easy of shipping, storage and usage, tag 10 is formed to be flat and of a generally uniform thickness. As a feature of the invention panel portion 11 may include a small diameter hole 12 formed therein to facilitate the stacking or hanging of a quantity of tags on a dowel pin or the like.

A second integral portion of tag 10 comprises a closed loop 13 having a first leg portion 14 that is attached to the edge 15 of panel 11 at point 16, and a second leg portion 17 that is attached to panel edge 15 at a point 18 that is spaced from point 16 by about 1.0 inch. In a preferred form of the invention, loop legs 14, 17 were formed to be flat on the bottom side thereof, were about 0.020 inch wide, and included a top arch having about a 0.01 inch radius.

This preferred construction of loop 13 is not to be taken as a limitation on the invention. For example, within the spirit and scope of the invention, points 16, 18 may comprise substantially the same point on an edge of panel portion 11.

While the material of panel 11 and loop 13 is not to be taken as a limitation on the invention, in its preferred form loop 13 will withstand a 100 pound pull test without breaking.

Figure 2:
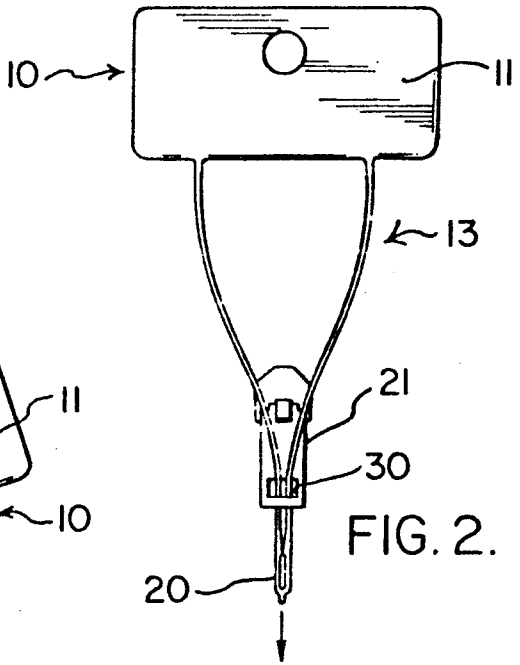
FIG 2 shows the tag of FIG. 1 as the loop portion thereof is being inserted into a opening in a zipper pull.
Figure 3:
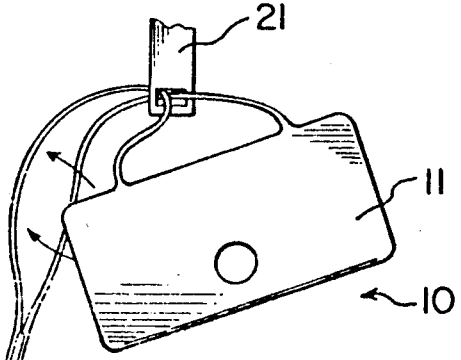
FIG. 3 shows the tag of FIG. 1 after the loop portion thereof has been inserted through the FIG. 2 zipper pull opening, and additionally shows the act of the tag's panel portion through the tag's loop portion.
Figure 4:
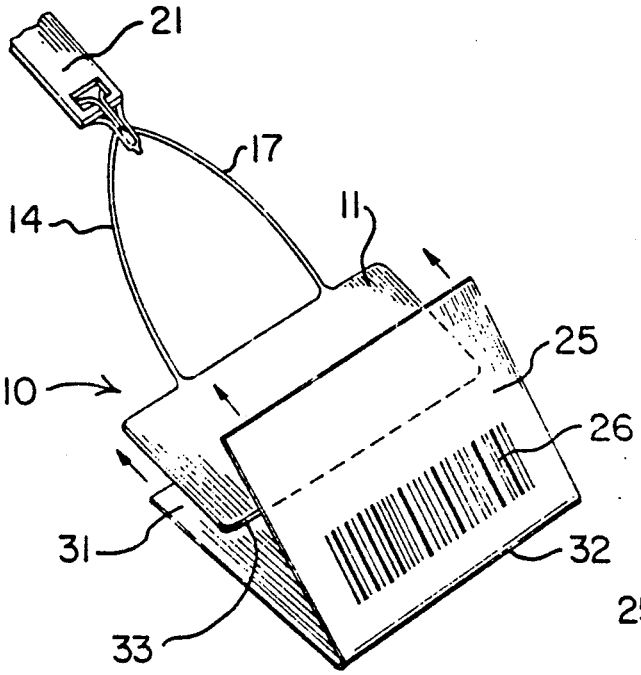
FIG. 4 shows how the tag's loop portion is secured to the zipper pull by the act of pulling on the panel portion, and additionally shows the act of placing a partially folded ski ticket on the tag's panel portion.
Figure 5:
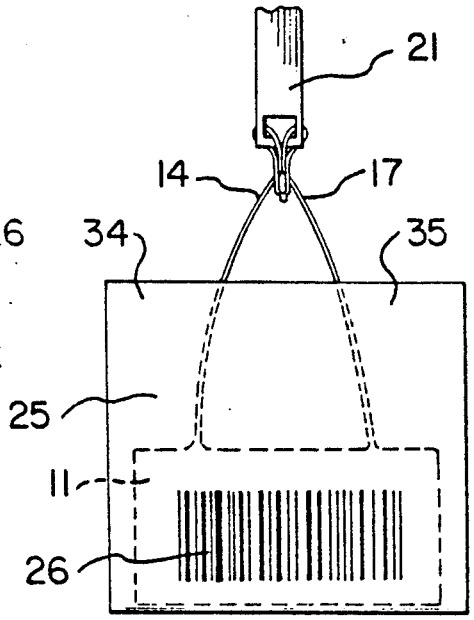
FIG. 5 shows the final form of the tag/ticket combination of the invention, wherein the ski ticket has been folded down onto the tag's panel portion, to thereby adhesively secure the ticket to the tag and to itself, and wherein the relatively large size of the ticket operates to trap portions of the tag's loop portion that are adjacent to the tag's panel portion, to thus shorten the effective length of the loop portion, and prevent unlooping the combination by attempting to reverse the act of FIG. 3.
Figure 6:
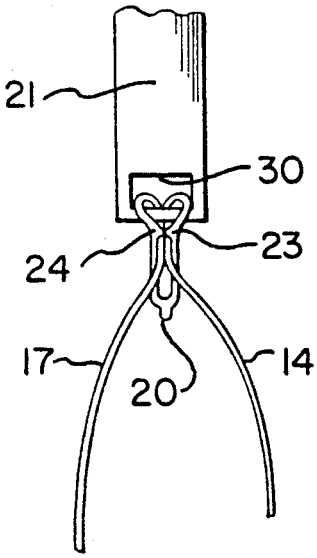
FIG. 6 is somewhat enlarged view showing the tag's loop portion secured to the zipper pull by the act of pulling on the panel portion, and additionally showing how the tag's loop portion is thereby secured in a slot that is formed in the nipple end of the loop portion.

The end 19 of loop 13 terminates in a nipple portion 20 that enables the loop to be easily threaded through an opening in an article of clothing, such as zipper pull 21 shown in FIGS. 2–5. In its preferred form, but without limitation thereto, the end 19 of loop 13 may also include a slot 22 and a pair of slot-narrowing tabs 23, 24 that enable loop legs 14, 17 to be trapped within slot 22 when tag 10 is mounted onto zipper pull 21, as is shown in FIGS. 4 and 5.

As will be appreciated by those of skill in the art, a number of such tags 10 can be injection molded at one time, the molded multi tag group being interconnected, for example, by break-off plastic runners (not shown) that extend between the panels 11 of adjacent tags within the group.

Panel portion 11 forms a wicket that is adapted to receive a paper or paper-like ski ticket 25, in the manner shown in FIGS. 4 and 5. In its preferred form, but without limitation thereto, ticket 25 may be formed of a plastic paper such as spun polyolefin, of which the brand Tyvek is an example, or of vinyl. A preferred property of ticket 25 is that it be impervious to adhesive solvents such as ether.

As is well known by those skilled in the art, ticket 25 when in its unfolded state comprises a rectangle having dimensions of about 4.5 inches by about 2.5 inches. Ticket 25 is usually printed on only one side thereof, and includes a layer of self sealing adhesive material on the other side, this adhesive layer being protected by a manually removable paper layer. The printed side of ticket 25 usually includes fold line 32 that divides the long dimension thereof, this fold line indicating to the purchaser the manner in which the ticket is to be affixed to a wicket.

For accounting purposes, each ticket 25 requires indicia of validation, for example a control number. For this purpose, the center area 26 on the front of each ticket 25 is reserved. The ticket will be of no value until it is validated by the individual ski resort, and each resort can choose the validation system that best suits its needs.

Some examples of validation alternatives include stamping, printing, embossing, or the use of a separate validation sticker that is applied at time of purchase. This validation data may comprise a combination of machine readable data, such as a bar code, and human readable text and graphic information data. This information may also include machine readable magnetic strip data. If desired, it is possible to print other information on ticket 25, such as the skier's responsibility code and any other information the resort wishes to include.

Whatever type data is used by the resort operator, it is desirable that the portion 26 of ticket 25 be maintained in a flat state for ease of machine reading and/or human observation, for example as the ticket is periodically checked by a ski lift operator using a hand held scanner.

As a feature of the invention, one of the unique functions of panel 11 is to maintain the portion 26 of ticket 25 in a flat state throughout an extended period of use.

In use, a customer purchases a ticket 25, and the issuing operator validates the ticket accordingly. Before the customer is allowed to use a ski lift, the lift operator requires that tag 10 be affixed to the customer's clothing, and that ticket 25 be affixed to tag 10.

FIG. 2 shows tag 10 as its loop portion 13 is being inserted into the opening 30 of a zipper pull 21.

The customer then pulls loop 13 substantially completely through opening 30.

FIG. 3 shows tag 10 after loop portion 13 has been inserted through zipper pull opening 30. The customer now opens loop 13, by spreading leg portions 14, 17 apart, and then inserts the tag's panel portion 11 between legs 14,17. The customer now pulls down on panel 11. This operates to tighten loop 13 about zipper pull 21. When tag 10 includes slot 22 and tabs 23, 24, this operation traps legs 14,17 within slot 22, thus securely binding tag 10 to zipper pull 21. FIG. 4 shows the the manner above described. The customer must now attach ticket 25 to tag 10.

The act of placing a partially folded ski ticket 25 on the tag's panel portion 11 is also shown in FIG. 4. Here it is assumed that the ticket's adhesive side 31 has been exposed by removal of the protecting layer of paper (not shown). Once fold 32 of ticket 25 has been located generally against the edge 33 of panel portion 11, the customer presses the ticket's two fold portions down upon the upper and lower surfaces of panel portion 11. Since these two fold portions of ticket 25 are larger than panel 11, the ticket's fold portions overlap at the areas generally indicated as 34 and 35 in FIG. 5. The self sealing adhesive material in these areas of ticket 25 operate to not only seal the ticket to tag 10, but also operate to trap portions of loop legs 14,17 so as to thereafter be inaccessible.

FIG. 5 shows the final form of the tag/ticket combination of the invention, wherein ski ticket 25 has been folded down onto the tag's panel portion 11, to thereby adhesively secure ticket 25 to itself, to tag 10 and to loop portions 14, 17. As is seen from this figure, the relatively large size of folded ticket 25 causes the ticket to overlap the portions 14, 17 of loop 13 that are adjacent to panel portion 11. In this way, these loop portions are trapped under folded ticket 25, and the effective length of loop 13 is greatly reduced relative to the length shown in FIG. 3. In addition, large ticket 25 operate to increase the effective size of panel portion 11 relative to the size shown in FIG. 3 This feature of the invention prevents unlooping the combination by attempting to reverse the act of inserting the panel/ticket combination between legs 14,17 of now-shortened loop 13, as was done in FIG. 3.

Thus, the tag/ticket combination is not removable from zipper pull 21 without virtually destroying the tag/ticket combination. Furthermore, the lift operator can pull on ticker 25 to inspection for gluing or structural tampering, while allowing ticket 25 to remain relatively loose, so as to adapt to the clothing and to the action of skiing.

While exemplary preferred embodiments of the invention are described herein with particularity, those having normal skill in the art will recognize various changes, modifications, additions and applications other than those specifically mentioned herein without departing from the spirit and scope of the invention.

What is claimed is:

1. A tag/ticket combination for attachment to a clothing opening, said tag/ticket combination providing a tamper resistant ticket, comprising:

an integral tag unit including a flat panel having a closed loop attached thereto, said loop comprising a thin, flexible, thread-like member having two ends attached to an edge portion of said panel and having a mid portion intermediate said two ends said loop having a length that enables the mid portion of said loop to be folded against itself, to thus allow said loop to be threaded through a clothing opening, said panel being of a relatively small size so as to enable said panel to thereafter be inserted through said loop, to thereby attach said loop to the clothing opening, and a relatively large size ticket having an adhesive on one side thereof, and having access indicia on the opposite side thereof, said ticket being folded to place said one adhesive side in abutting relation to said panel so as to overlap said two ends of said loop and thereby prevent removal of said tag/ticket by reinsertion of said panel through said loop.

2. The tag/ticket combination of claim 1 wherein said ticket includes indicia of access thereon overlying said flat panel, said flat panel operating to maintain said indicia of access in a flat state for convenient reading.

3. The tag/ticket combination of claim 2 wherein said tag unit is formed of an injection molded plastic, and wherein said ticket is formed of a paper that is substantially impervious to adhesive solvents.

4. The tag/ticket combination of claim 3 wherein said indicia of access includes data storing means whereby the information represented by data contained in said storing means is automatically readable by a compatible machine reader.

5. The tag/ticket combination of claim 4 wherein said data storing means comprises bar code means.

6. The tag/ticket combination of claim 1 wherein said loop comprising a pair of thin, flexible, thread-like members that are attached at one end to form a threading nipple, and wherein the two other ends of said pair of thread-like members are attached to spaced edge portions of said panel.

7. The tag/ticket combination of claim 6 including an internal slot portion formed at said threading nipple, and slot-narrowing tabs formed on each of said thread-like members, whereby said legs are trapped within said slot when said threading nipple is threaded through the clothing opening, and said panel is thereafter inserted through said loop, and a pulling force is thereafter exerted on said panel.

8. The tag/ticket combination of claim 7 wherein said tag unit is formed of an injection molded polyamide type material and wherein said ticket is formed of a plastic type paper.

9. The tag/ticket combination of claim 8 wherein said ticket includes indicia of access printed thereon so as to overly said flat panel, said flat panel operating top maintain said indicia of access in a flat state for convenient reading.

10. The tag/ticket combination of claim 9 wherein said indicia of access includes machine readable data, said data being readable by a compatible machine reader.

11. The tag/ticket combination of claim 10 wherein said machine readable data comprises bar code data.

12. The tag/ticket combination of claim 1 wherein said ticket includes a self sealing adhesive on said one side thereof, and wherein the relatively large size of said ticket operates to trap a portion of said loop under engaging self sealing portions of said ticket, whereby detachment and resecuring of said tag/ticket combination can be detected by inspecting the tag/ticket combination after it is attached to the clothing opening.

13. The tag/ticket combination of claim 12 wherein said tag unit and said loop are integrally formed of an injection molded plastic, and wherein said ticket is formed of a paper-like material that is substantially impervious to adhesive solvents.

14. The tag/ticket combination of claim 13 wherein said loop comprises a pair of thread-like members that are attached at one end to form a threading nipple, and wherein the two other ends of said pair of thread-like members are attached to spaced edge portions of said panel.

15. The tag/ticket combination of claim 14 including a an internal slot portion formed at said threading nipple, and slot-narrowing tabs formed on each of said thread-like members, whereby said legs are trapped within said slot when said threading nipple is threaded through the clothing opening, and said panel is thereafter inserted through said loop, and a pulling force is thereafter exerted on said panel.

16. The tag/ticket combination of claim 15 wherein said ticket includes indicia of access printed thereon so as to overly said flat panel, said flat panel operating top maintain said indicia of access in a flat state for convenient reading.

17. The tag/ticket combination of claim 16 wherein said indicia of access includes machine readable data, said data being readable by a machine reader.

18. The tag/ticket combination of claim 17 wherein said machine readable data comprises bar code data.

19. A method for providing a tamper resistant tag/-ticket combination for attachment to a clothing opening, said tag/ticket combination including ticket indicia authorizing access to a facility, the method comprising the steps of;

providing a one-piece tag unit that includes a flat panel having a closed loop attached thereto, threading a portion of said loop through a clothing opening, thereafter inserting said panel through said loop and pulling on said panel, to thereby attach said loop to the clothing opening, and folding a relatively large size ticket having an adhesive on one side thereof and fixing the folded adhesive side of said ticket to said flat panel, such that said adhesive side of said ticket is in abutting relation to said panel and overlaps a portion of said loop that is adjacent to said panel, to thereby enlarge the effective size of said panel and prevent removal of said tag/ticket combination by attempting the act of reinserting said panel through said loop.

20. The method of claim 19 wherein said ticket includes indicia of access thereon that overlies said flat panel, and wherein said flat panel operates to maintain said indicia of access in a flat state for observation thereof.

21. The method of claim 20 including the steps of forming said one-piece tag unit by injection molding a polyamide type material, and forming said ticket from a polyolefin type paper.

22. The method of claim 21 wherein said ticket includes a self sealing adhesive on said one side thereof, and wherein the relatively large size of said ticket operates to trap a portion of said loop under engaging self sealing portions of said ticket, whereby detachment of said tag/ticket combination from the clothing opening, and resecuring of said tag/ticket combination to another clothing opening can be detected by visually inspecting the tag/ticket combination.

23. The method of claim 20 including the steps of forming said one-piece tag unit by injection molding a plastic material.

24. The method of claim 23 including the step of utilizing a colored plastic material for said one-piece tag unit as an indicia of authorization.

25. The method of claim 20 wherein said indicia of access includes data storing means automatically readable by compatible reader means.

26. The method of claim 19 including the steps of providing said closed loop as a pair of thin, flexible, thread-like members that are attached at one end to form a threading nipple, the two other ends of said pair of thread-like members being attached to spaced edge portions of said flat panel, said loop having a length that enables said threading nipple to be threaded through the clothing opening.

27. The method of claim 26 including the steps of providing an internal slot portion at said threading nipple, and providing mating slot-narrowing tabs on each of said thread-like members, whereby said legs are trapped within said slot when said threading nipple is threaded through the clothing opening and a pulling force is exerted on said panel.

* * * * *